US011654678B2

(12) United States Patent
Olbrich et al.

(10) Patent No.: US 11,654,678 B2
(45) Date of Patent: May 23, 2023

(54) NOZZLE CHARACTERISTICS

(71) Applicant: HEWLETT-PACKARD DEVELOPMENT COMPANY, L.P., Spring, TX (US)

(72) Inventors: Craig Olbrich, Corvallis, OR (US); Joseph M Torgerson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/483,084

(22) PCT Filed: Apr. 6, 2017

(86) PCT No.: PCT/US2017/026297
§ 371 (c)(1),
(2) Date: Aug. 2, 2019

(87) PCT Pub. No.: WO2018/186862
PCT Pub. Date: Oct. 11, 2018

(65) Prior Publication Data

US 2020/0114646 A1 Apr. 16, 2020

(51) Int. Cl.
*B41J 2/07* (2006.01)
*B41J 2/045* (2006.01)
(Continued)

(52) U.S. Cl.
CPC ..... *B41J 2/072* (2013.01); *B41J 2/04563* (2013.01); *B41J 2/125* (2013.01); *B41J 2002/14354* (2013.01)

(58) Field of Classification Search
CPC ..... B41J 2/16526; B41J 2/04515; B41J 2/04563; B41J 2/0458
See application file for complete search history.

(56) References Cited

U.S. PATENT DOCUMENTS 4,860,027 A 8/1989 Ozelis et al.
4,896,172 A 1/1990 Nozawa et al.
(Continued)

FOREIGN PATENT DOCUMENTS

EP 0482850 4/1992
JP S61266250 11/1986
(Continued)

OTHER PUBLICATIONS

Cibis, et al. Influencing Parameters in Droplet Formation for DoD Printing of Conductive Inks. Apr. 21-24, 2008. Institute of Automation Technology. Hamburg, Germany.
(Continued)

*Primary Examiner* — Lam S Nguyen
(74) *Attorney, Agent, or Firm* — Foley & Lardner LLP

(57) ABSTRACT

Examples include a fluid ejection device. The fluid ejection device comprises a fluid ejection die and a control engine. The fluid ejection die comprises nozzles to eject fluid drops and a temperature sensors disposed on the die to sense temperatures associated with nozzles. The control engine determines at least one nozzle characteristic of at least one respective nozzle based at least in part on a temperature change associated with the at least one respective nozzle corresponding to at least one ejection event.

8 Claims, 8 Drawing Sheets

(51) Int. Cl.
*B41J 2/125* (2006.01)
*B41J 2/14* (2006.01)

(56) References Cited

U.S. PATENT DOCUMENTS

| | | | | |
|---|---|---|---|---|
| 6,231,167 | B1 | 5/2001 | Tsuboi et al. | |
| 6,322,189 | B1 | 11/2001 | Anderson et al. | |
| 6,460,964 | B2 | 10/2002 | Osborne | |
| 6,634,731 | B2 * | 10/2003 | Kao | B41J 2/04515 347/14 |
| 6,827,416 | B2 | 12/2004 | Matsumoto et al. | |
| 6,866,359 | B2 | 3/2005 | Pan et al. | |
| 7,125,110 | B2 | 10/2006 | Merz et al. | |
| 7,490,919 | B2 * | 2/2009 | Combs | B41J 2/04563 347/19 |
| 7,699,425 | B2 | 4/2010 | Tanaka et al. | |
| 8,091,993 | B2 | 1/2012 | Gibson et al. | |
| 8,226,188 | B2 | 7/2012 | Nishimura | |
| 8,474,937 | B2 | 7/2013 | Jeong et al. | |
| 8,506,063 | B2 | 8/2013 | Limb et al. | |
| 8,628,160 | B2 | 1/2014 | Takano et al. | |
| 9,475,304 | B2 | 10/2016 | Sugitani et al. | |
| 2001/0012031 | A1 | 8/2001 | Miyake et al. | |
| 2002/0113852 | A1 | 8/2002 | Kimura et al. | |
| 2003/0202073 | A1 | 10/2003 | Dowell et al. | |
| 2007/0291066 | A1 | 12/2007 | Takabayashi et al. | |
| 2007/0291069 | A1 | 12/2007 | Shihoh et al. | |
| 2008/0055378 | A1 | 3/2008 | Drury et al. | |
| 2009/0021542 | A1 | 1/2009 | Kanfoush et al. | |
| 2009/0115814 | A1 | 5/2009 | Combs et al. | |
| 2010/0214378 | A1 | 8/2010 | Katoh et al. | |
| 2013/0194335 | A1 | 8/2013 | Nodsu | |
| 2014/0240386 | A1 | 8/2014 | Hagiwara et al. | |
| 2014/0300657 | A1 * | 10/2014 | Ike | B41J 2/0458 347/14 |
| 2015/0343763 | A1 * | 12/2015 | Zhang | B41J 2/16526 347/10 |
| 2016/0159089 | A1 | 6/2016 | Kaneko | |
| 2016/0214378 | A1 | 7/2016 | Yoshida et al. | |

FOREIGN PATENT DOCUMENTS

| | | | |
|---|---|---|---|
| JP | H02162054 | | 6/1990 |
| RU | 2207958 | C2 | 7/2003 |
| RU | 2007114584 | A | 10/2008 |
| WO | 2015/080709 | A1 | 6/2015 |

OTHER PUBLICATIONS

Kwon, et al. Inkjet jet failures and their detection using piezo self sensing. Sensors and Actuators A 201, ScienceDirect, 2013, pp. 335-341.

* cited by examiner

NOZZLE CHARACTERISTICS

BACKGROUND

Fluid ejection dies may eject fluid drops via nozzles thereof. Nozzles may include fluid ejectors that may be actuated to thereby cause ejection of drops of fluid through nozzle orifices of the nozzles. Some example fluid ejection dies may be printheads, where the fluid ejected may correspond to ink.

DRAWINGS

Figure 1:
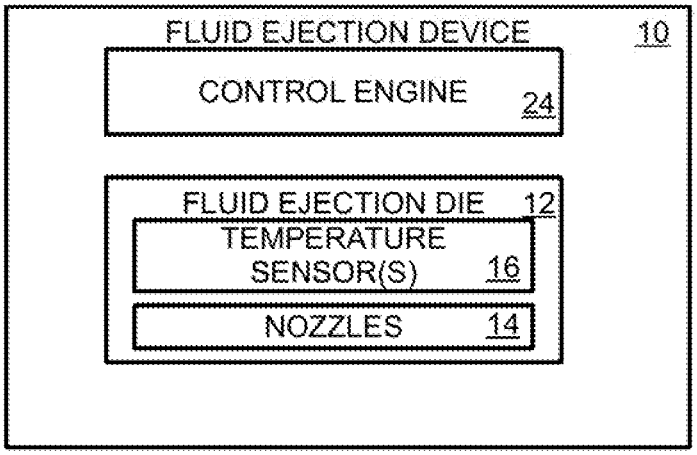
FIG. 1 is a block diagram that illustrates some components of an example fluid ejection device.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DESCRIPTION

Examples of fluid ejection devices may comprise at least one fluid ejection die. Example fluid ejection dies may comprise a plurality of ejection nozzles that may be arranged in a set, where such plurality of nozzles may be referred to as a set of nozzles. In some examples, each nozzle may comprise a fluid chamber, a nozzle orifice, and a fluid ejector. A fluid ejector may include a piezoelectric membrane based actuator, a thermal resistor based actuator (which may be referred to as a thermal fluid ejector), an electrostatic membrane actuator, a mechanical/impact driven membrane actuator, a magneto-strictive drive actuator, or other such elements that may cause displacement of fluid responsive to electrical actuation. Furthermore, example fluid ejection dies may comprise at least one temperature sensor disposed thereon. In some examples, a fluid ejection die may comprise at least one temperature sensor for each set of nozzles. In some examples, a fluid ejection die may comprise at least one temperature sensor for each nozzle.

In such examples, for a respective nozzle, an actuation signal may be transmitted to the respective nozzle to cause actuation of a fluid ejector disposed in the respective nozzle.

Due to actuation of the fluid ejector, the nozzle may eject a drop of fluid. As used herein, an ejection event may refer to the actuation and subsequent ejection of at least one fluid drop from at least one nozzle. Moreover, it may be noted that in some examples, a plurality of nozzles may be actuated concurrently such that a plurality of fluid drops may be ejected concurrently. Accordingly, in these examples, an ejection event refers to the concurrent actuation and ejection of fluid drops from a plurality of respective nozzles.

In some example fluid ejection systems, as fluid is ejected via nozzles, a temperature change may occur. For example, if fluid ejectors of the nozzles correspond to thermal fluid ejectors, a temperature of a fluid ejection die may increase responsive to actuation of the thermal fluid ejector. In addition, when fluid drops are ejected from the nozzle, a temperature decrease/cooling effect may occur. Accordingly, an ejection event for a fluid ejection die may facilitate a temperature change of the fluid ejection die. In addition, a volume of fluid ejected for a particular nozzle (i.e., a size of a fluid drop) may correspond to the cooling effect achieved by the ejection action. Therefore, due to the actuation of the fluid ejector and/or the ejection of a fluid drop, a temperature associated with the nozzle may change in an expected manner. Furthermore, a temperature change may further include a rate of change of the temperature of a nozzle or a set of nozzles over time. In other examples, a temperature change may include a rate of change of the temperature of a nozzle or a set of nozzles over a number of ejection events.

Example fluid ejection devices may include a control engine, where the control engine may monitor temperatures of the nozzles of the fluid ejection die during operation of the fluid ejection die. Based on the temperature of the nozzles associated with ejection events, the control engine may determine nozzle characteristics for nozzles of the fluid ejection die. In some examples, a nozzle characteristic that may be determined may include an operational status of at least one respective nozzle, where an operational status may include whether a nozzle is operative or non-operative. In some examples, a nozzle characteristic that may be determined may include a volume of fluid ejected for fluid drops of at least one ejection event. In some examples, a nozzle characteristic that may be determined may include whether at least one respective nozzle is at least partially blocked. These and other nozzle characteristics may be determined as described herein.

As shown herein, example fluid ejection devices may comprise engines, where such engines may be any combination of hardware and programming to implement the functionalities of the respective engines. In some examples described herein, the combinations of hardware and programming may be implemented in a number of different ways. For example, the programming for the engines may be processor executable instructions stored on a non-transitory machine-readable storage medium and the hardware for the engines may include a processing resource to process and execute those instructions.

In some examples, a fluid ejection device implementing such engines may include the machine-readable storage medium storing the instructions and the processing resource to process the instructions, or the machine-readable storage medium may be separately stored and accessible by the system and the processing resource. In some examples, engines may be implemented in circuitry. Moreover, processing resources used to implement engines may comprise a processing unit (CPU), an application specific integrated circuit (ASIC), a specialized controller, and/or other such types of logical components that may be implemented for data processing.

Some examples contemplated herein may compare temperatures and/or temperature changes associated with nozzles of a fluid ejection die to an expected temperature or an expected range of temperatures. In such examples, at least one nozzle characteristic of at least one respective nozzle may be determined based at least in part on whether temperature and/or temperature changes associated with the at least one nozzle are within an expected range. An expected temperature or an expected temperature range may be predefined, or such expected temperature or expected temperature range may be determined by the device during performance of operations by the device.

For example, temperatures of a nozzle may be monitored during ejection of fluid drops with the nozzle for a set of 10 ejection events. Based on previous performances of the set of 10 ejection events, examples may have an expected range of temperature changes that occur for nozzles when performing the 10 ejection events. In other examples, an example fluid ejection device may have an expected temperature change range for a given duration when performing ejection events, such as one minute. In such examples, the fluid ejection device may compare a measured temperature change over one minute to the expected temperature change range. In some examples, the fluid ejection device may determine nozzle characteristics based at least in part on a rate of change of a temperature associated with a nozzle. In such examples, an expected rate of change of a temperature associated with a nozzle may be compared to a determined rate of change for the nozzle during one ejection event or a set of ejection events when determining nozzle characteristics. These and other similar examples are contemplated herein.

Turning now to the figures, and particularly to FIG. 1, this figure provides a block diagram that illustrates some components of an example fluid ejection device 10. As shown, the fluid ejection device may comprise at least one fluid ejection die 12. The at least one fluid ejection die 12 may comprise nozzles 14 and at least one temperature sensor 16. In addition, the fluid ejection device 10 further comprises a control engine 24. As described previously, the control engine 24 may monitor temperature of the nozzles 14 during ejection events with the temperature sensors 16, and the control engine 24 may determine nozzle characteristics of nozzles 14 based at least in part on the temperature.

Figure 2:
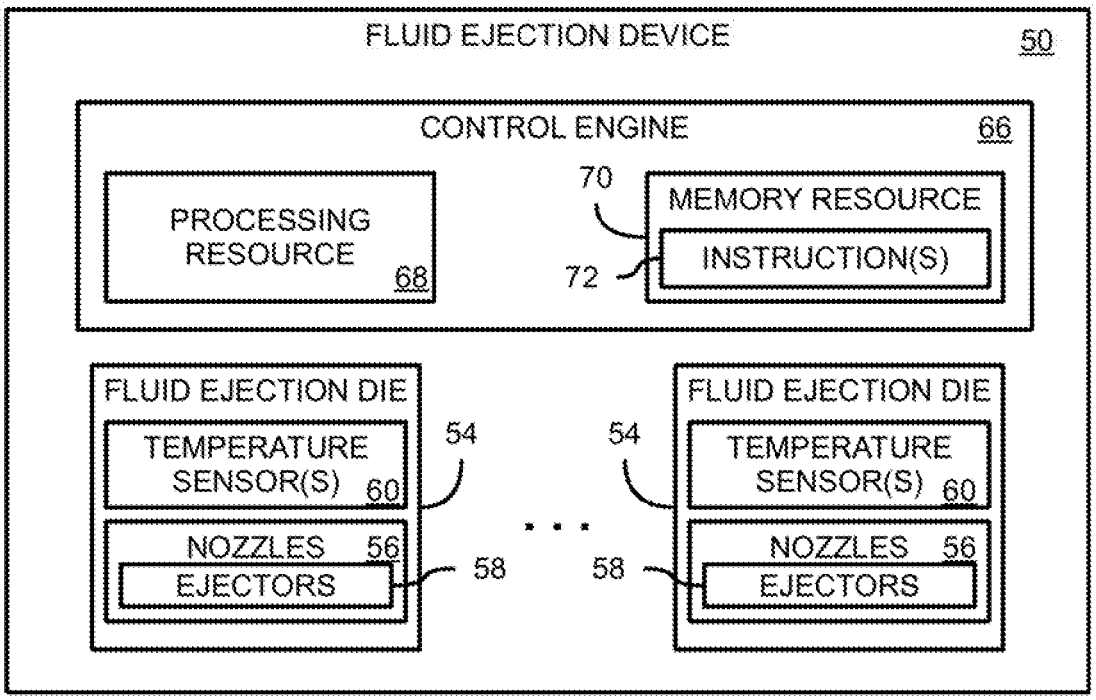
FIG. 2 is a block diagram that illustrates some components of an example fluid ejection device.

FIG. 2 provides a block diagram that illustrates some components of an example fluid ejection device 50. In this example, the fluid ejection device 50 may comprise fluid ejection dies 54. Each fluid ejection die 54 comprises nozzles 56 with fluid ejectors 58 disposed therein, and the fluid ejection dies 54 further comprise at least one temperature sensor 60. As described in previous examples, the fluid ejection device 50 further comprises a control engine 66. As shown, the control engine may comprise at least one processing resource 68 and at least one memory resource 70 that stores executable instructions 72. Execution of instructions 636 may cause the processing resource 68 and/or fluid ejection system 50 to perform functionalities, processes, and/or sequences of operations described herein. Notably, the memory resource 70 may be non-transitory.

The control engine 66 may monitor temperatures associated nozzles 56 with the temperature sensors 60 thereof. Based at least in part on the temperatures associated with the nozzles of the fluid ejection dies 54 associated with at least one ejection event, a temperature change associated with nozzles 56 actuated for the at least one ejection event may be determined. Based on such temperature changes, nozzle characteristics of at least one respective nozzle 56 may be determined.

Figure 3A:
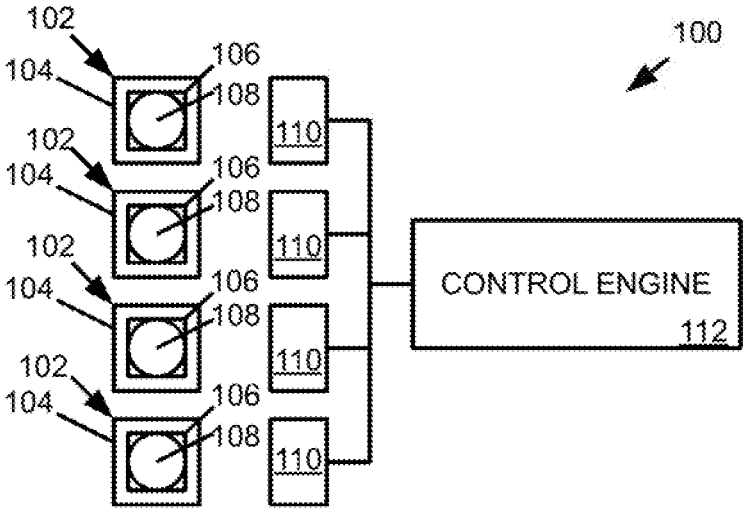
FIGS. 3A and 3B are block diagrams that illustrate some components of an example fluid ejection device.
Figure 3B:
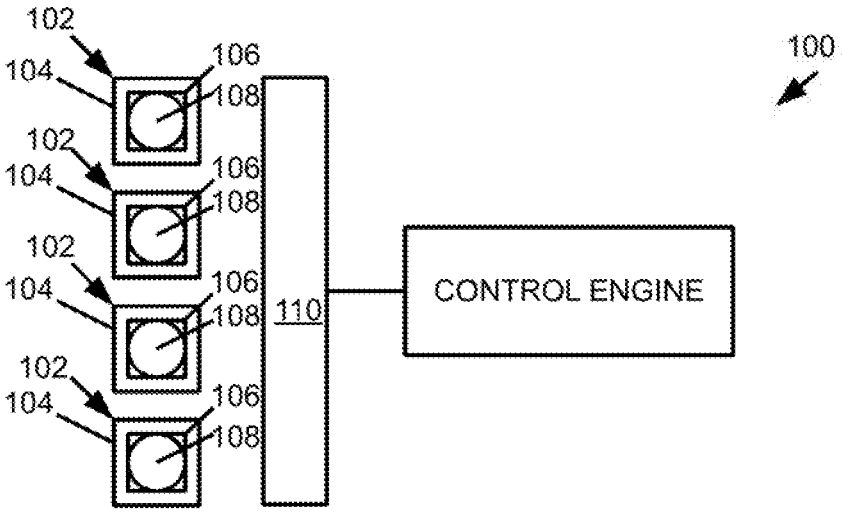

FIGS. 3A-B provide block diagrams that illustrate some components of an example fluid ejection device 100. In these examples, the fluid ejection device 100 comprises nozzles 102, where each nozzle includes an ejection chamber 104, a fluid ejector 106 disposed in the ejection chamber 104, and a nozzle orifice 106 formed in a portion of the ejection chamber 104. Examples described herein may include thermal fluid ejectors, such that actuation of a respective fluid ejector 106 of a respective nozzle 104 may cause formation of a vapor bubble proximate the fluid ejector 106. The vapor bubble may cause displacement of fluid in the ejection chamber 104 such that the displaced fluid may be ejected via the nozzle orifice 108 as a fluid drop. As mentioned previously, actuation of the respective fluid ejector 106 may cause a temperature increase in the respective nozzle 102.

In the example of FIG. 3A, the fluid ejection device 100 includes a respective temperature sensor 110 positioned proximate each respective nozzle 102. Accordingly, in this example, a control engine 112 of the fluid ejection device 100 may monitor a temperature of each nozzle 102 with at least the respective temperature sensor 110 disposed proximate the respective nozzle 102. In some examples, the control engine may further determine a temperature for a respective nozzle 102 based at least in part on temperatures sensed by temperature sensors 110 disposed proximate neighboring nozzles 102. Accordingly, as described herein, a temperature associated with a respective nozzle 102 may correspond to a temperature sensed by a temperature sensor 110 disposed proximate the respective nozzle 102. In the example of FIG. 3B, the fluid ejection device comprises a temperature sensor 110 for a group of neighboring nozzles 102. Accordingly, in this example, a temperature associated with a respective nozzle 102 may be monitored and determined by the respective temperature sensor 110 for the group of neighboring nozzles 102. The examples of FIGS. 3A and 3B are provided to illustrate example configurations of nozzles and temperature sensors. Other examples may include various other arrangements of nozzles and temperature sensors, where such other examples may include more or less temperature sensors per nozzle.

FIGS. 4-7 provide flowcharts that provide example sequences of operations that may be performed by an example fluid ejection device and/or a processing resource thereof to perform example processes and methods. In some examples, the operations included in the flowcharts may be embodied in a memory resource (such as the example memory resource 70 of FIG. 2) in the form of instructions that may be executable by a processing resource to cause the an example fluid ejection device and/or a control engine thereof to perform the operations corresponding to the instructions. Additionally, the examples provided in FIGS. 4-7 may be embodied in device, machine-readable storage mediums, processes, and/or methods. In some examples, the example processes and/or methods disclosed in the flowcharts of FIGS. 4-7 may be performed by one or more engines. Moreover, performance of some example operations described herein may include control of components and/or subsystems of the fluid ejection device by a control engine thereof to cause performance of such operations. For example, ejection of fluid drops with a fluid ejection die of the device may include control of the fluid ejection die by the control engine to cause such ejection of fluid drops.

Figure 4:
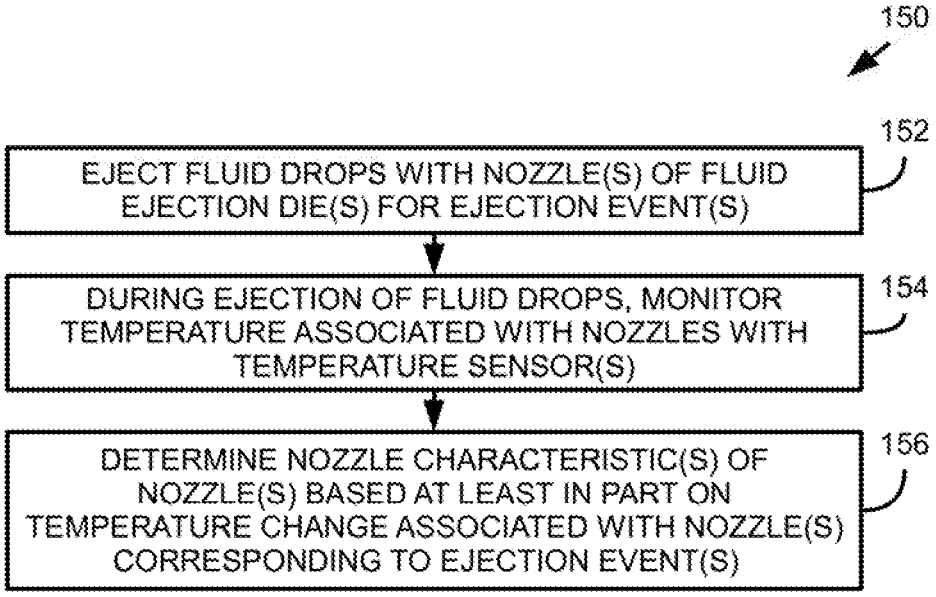
FIG. 4 is a flowchart that illustrates an example sequence of operations that may be performed by an example fluid ejection device.

Turning now to FIG. 4, this figure provides a flowchart 150 that illustrates an example sequence of operations that may be performed by an example fluid ejection device. The fluid ejection device may eject fluid drops with a nozzle or a set of nozzles of a fluid ejection die for at least one ejection event (block 152). During ejection of the fluid drops, the fluid ejection device may monitor temperatures associated with the nozzle or set of nozzles with temperature sensors of the fluid ejection die (block 154). Based at least in part on temperature changes of temperatures associated with the nozzle corresponding to the at least one ejection event, the fluid ejection device may determine at least one nozzle characteristic of the nozzle (block 156).

For example, if a particular nozzle is actuated (i.e., the fluid ejector of the nozzle is electrically actuated) for a set of ejection events, an example fluid ejection device may monitor the temperature change of at least one temperature sensor disposed proximate the nozzle due to the actuation. As discussed previously, the temperature associated with the nozzle may increase due to actuation of the nozzle for ejection, and the temperature associated with the nozzle may decrease due to fluid drop ejection. Accordingly, over the set of ejection events for which the nozzle is actuated, a temperature change may occur. Based on the temperature change for the nozzle, the fluid ejection device may determine whether the nozzle is operative (e.g., ejecting fluid drops), whether the nozzle is partially or fully blocked, an average drop volume of the fluid drops ejected for the set of ejection events, and/or other such nozzle characteristics.

Figure 5:
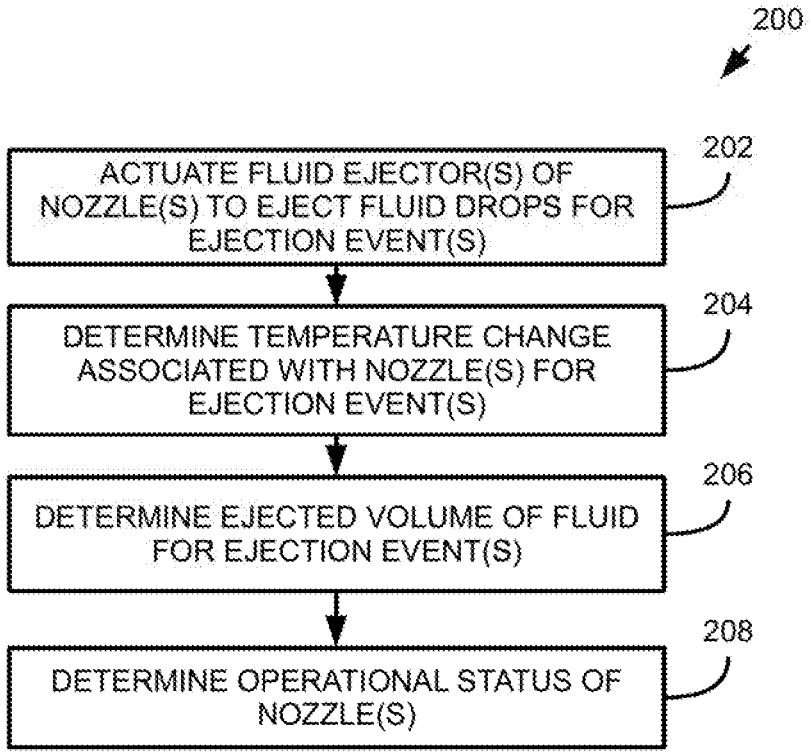
FIG. 5 is a flowchart that illustrates an example sequence of operations that may be performed by an example fluid ejection device.

FIG. 5, provides a flowchart 200 that illustrates an example sequence of operations that may be performed by an example fluid ejection device. In this example, fluid ejectors of nozzles of a fluid ejection die of the fluid ejection device may be actuated for at least one ejection event (block 202). A temperature change associated with each nozzle actuated for the at least one ejection event may be determined (block 204). A volume of fluid ejected for the at least one ejection event may be determined based at least in part on the temperature change associated with each nozzle (block 206). Based at least in part on the volume of fluid ejected for the at least one ejection event, examples herein may determine an operational status of the nozzles (block 208).

In this example, it may be appreciated that a plurality of nozzles may be actuated concurrently for one ejection event or a set of ejection events. Accordingly, in this example, the fluid ejection system may determine that some nozzles of the plurality ejected are non-operative without determining the specific nozzles. In other similar examples, the fluid ejection device may determine the operational status of specific nozzles by analyzing temperature changes associated with the nozzles for a set of ejection events in which different combinations of nozzles are ejected concurrently. In other examples, the fluid ejection device may determine the operational status of each nozzle based on a respective temperature change associated with the respective nozzle.

Figure 6:
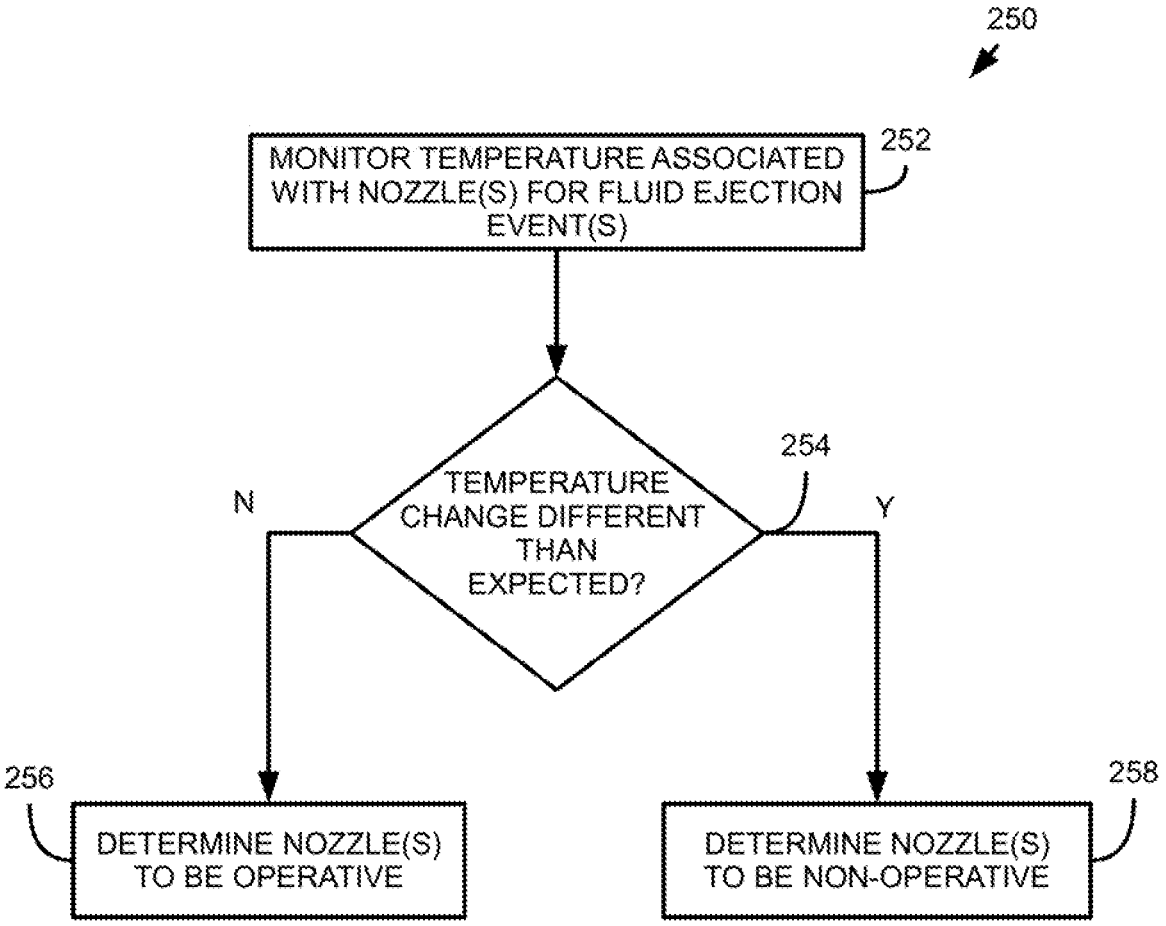
FIG. 6 is a flowchart that illustrates an example sequence of operations that may be performed by an example fluid ejection device.

FIG. 6 provides a flowchart 250 that illustrates an example sequence of operations that may be performed by an example fluid ejection device. The fluid ejection device may monitor temperatures associated with nozzles of a fluid ejection die thereof for fluid ejection events (block 252). The fluid ejection device may compare the determined temperature change for a nozzle to an expected temperature change for the nozzle (block 254). If the temperature change for a respective nozzle is different than an expected temperature change ('Y' branch of block 254), the fluid ejection device may determine that the nozzle is non-operative (block 256). If the temperature change of a respective nozzle is approximate the expected temperature change ('N' branch of block 254), the example fluid ejection device may determine that the respective nozzle is operative (block 258). In some examples, the fluid ejection device may determine that a nozzle or a group of nozzles are non-operative if the temperature change is greater than an expected temperature change. As used herein, a temperature change for a respective nozzle or group of nozzles may be determined to be approximate an expected temperature change if the temperature change is within a range of ±10%.

Figure 7:
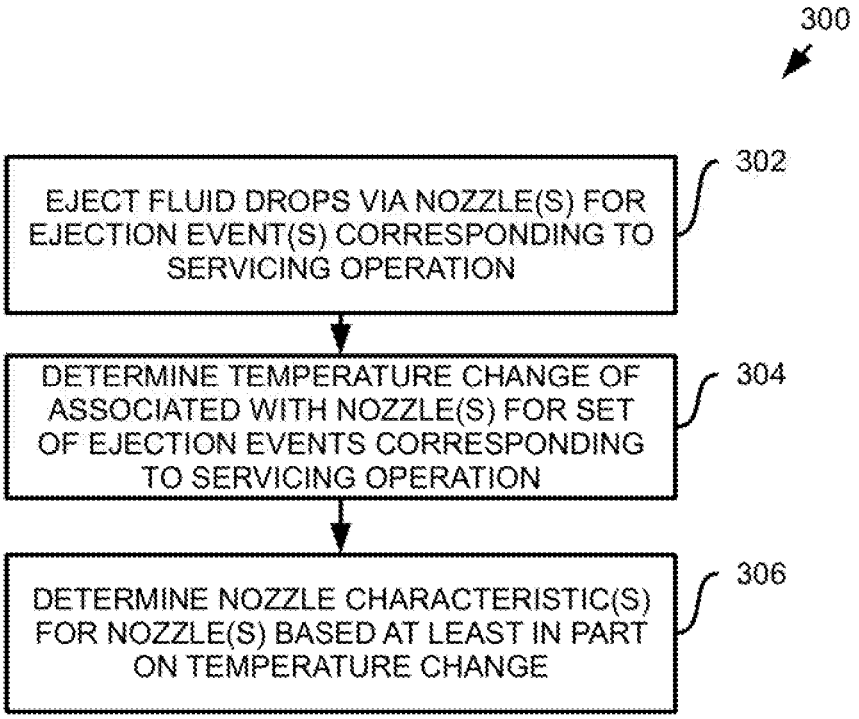
FIG. 7 is a flowchart that illustrates an example sequence of operations that may be performed by an example fluid ejection device.

FIG. 7 provides a flowchart 300 that illustrates a sequence of operations that may be performed by an example fluid ejection device. In some examples, the fluid ejection device may perform servicing operations associated with fluid ejection dies thereof. Some examples of servicing operations include nozzle ejection operations to reduce nozzle clogging, crusting, and/or other issues that may occur. In such examples, a servicing operation may define particular nozzles to be ejected in a specified order for a set of ejection events corresponding to the servicing operation. Accordingly, in these examples, the fluid ejection device may eject fluid drops via nozzles of fluid ejection dies thereof for a set of ejection events corresponding to the servicing operation with (block 302). The system may determine at least one nozzle characteristic for at least one nozzle based at least in part on the determined temperature change associated with the at least one nozzle (block 306).

Figure 8:
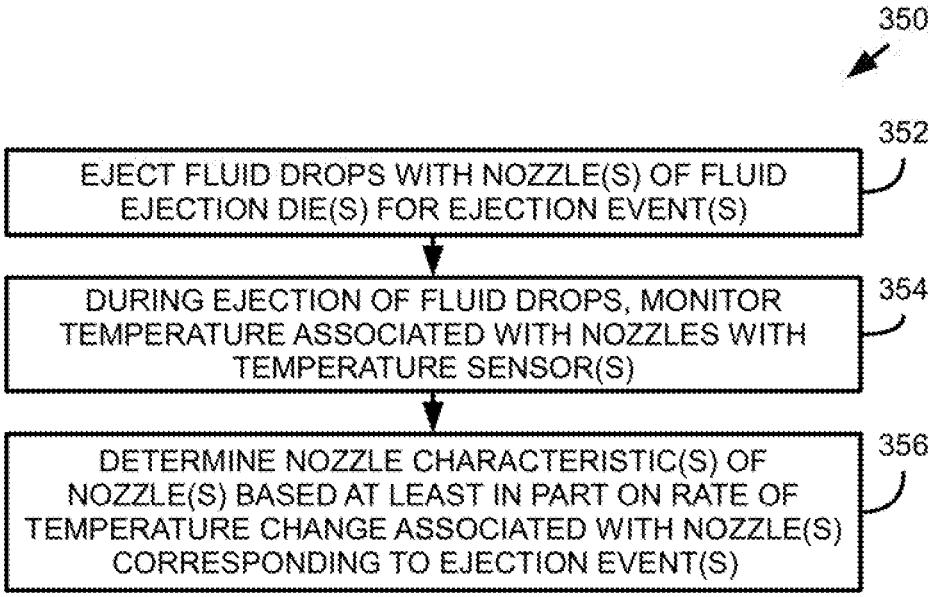
FIG. 8 is a flowchart that illustrates an example sequence of operations that may be performed by an example fluid ejection device.

Turning now to FIG. 8, this figure provides a flowchart 350 that illustrates an example sequence of operations that may be performed by an example fluid ejection device. The fluid ejection device may eject fluid drops with a nozzle or a set of nozzles of a fluid ejection die for at least one ejection event (block 352). During ejection of the fluid drops, the fluid ejection device may monitor temperatures associated with the nozzle or set of nozzles with temperature sensors of the fluid ejection die (block 354). Based at least in part on a rate of change of temperature associated with the nozzle corresponding to the at least one ejection event, the fluid ejection device may determine at least one nozzle characteristic of the nozzle (block 356).

Accordingly, examples provided herein may provide a fluid ejection device in which nozzle characteristics of nozzles of fluid ejection dies thereof may be monitored and determined based at least in part on measured temperatures associated with the nozzles. Moreover, examples described herein may monitor temperature changes for nozzles associated with ejection events. By monitoring temperature and temperature change with temperature sensors proximate nozzles, examples may determine characteristics and conditions of the nozzles.

The preceding description has been presented to illustrate and describe examples of the principles described. This description is not intended to be exhaustive or to limit these principles to any precise form disclosed. Many modifications and variations are possible in light of the description. In addition, while various examples are described herein, elements and/or combinations of elements may be combined and/or removed for various examples contemplated hereby. For example, the example operations provided herein in the flowcharts of FIGS. 4-8 may be performed sequentially, concurrently, or in a different order. Moreover, some example operations of the flowcharts may be added to other flowcharts, and/or some example operations may be removed from flowcharts. In addition, the components illustrated in the examples of FIGS. 1, 2, 3A, and 3B may be added and/or removed from any of the other figures. Therefore, the foregoing examples provided in the figures and described herein should not be construed as limiting of the scope of the disclosure, which is defined in the Claims.

The invention claimed is:

1. A fluid ejection device comprising:

a fluid ejection die comprising a plurality of nozzles to eject fluid drops, the fluid ejection die further comprising a plurality of temperature sensors disposed thereon to sense temperatures associated with nozzles of the plurality of nozzles; and a control engine:

to determine at least one nozzle characteristic for at least one respective nozzle of the plurality of nozzles based at least in part on a temperature change associated with the at least one respective nozzle corresponding to at least one ejection event; and to control the fluid ejection die to eject drops of fluid for a set of ejection events for a servicing operation;

wherein the at least one ejection event comprises the set of ejection events for the servicing operation, and the temperature change corresponds to the set of ejection events for the servicing operation, and the control engine is to determine the at least one nozzle characteristic for at least one respective nozzle based at least in part on the temperature change corresponding to the set of ejection events for the servicing operation.

2. The fluid ejection device of claim 1, wherein the control engine is further to:

determine a respective volume of fluid ejected for the at least one ejection event based at least in part on the temperature change, and wherein the control engine is to determine the at least one nozzle characteristic for the at least one respective nozzle based at least in part on the respective volume of fluid ejected for the at least one ejection event.

3. The fluid ejection device of claim 1, wherein each respective nozzle of the plurality includes a respective thermal fluid ejector.

4. The fluid ejection device of claim 1, wherein the at least one respective nozzle comprises a set of nozzles, and at least one nozzle characteristic comprises an operational status of the set of nozzles.

5. The fluid ejection device of claim 4, wherein the control engine is further to:

determine the operational status of the set of nozzles based at least in part on whether the temperature change for the set of ejection events is different than an expected temperature change.

6. The fluid ejection device of claim 5, wherein the control engine is further to:

determine that the set of nozzles includes non-operative nozzles when the temperature change for the set of ejection events is different than the expected temperature change.

7. The fluid ejection device of claim 1, wherein the control engine is further to:

determine the at least one nozzle characteristic for the at least one respective nozzle based at least in part on a rate of change of temperature associated with the at least one respective nozzle.

8. A method for a fluid ejection device, comprising:

ejecting fluid via at least one nozzle of at least one fluid ejection die of the fluid ejection device for at least one ejection event;

during ejecting of the fluid via the nozzles of the at least one fluid ejection die of the fluid ejection device for the at least one ejection event, monitoring a temperature associated with the at least one nozzle with at least one temperature sensor disposed on the at least one fluid ejection die; and determining at least one nozzle characteristic of the at least one nozzle based at least in part on a rate of change of temperature associated with the at least one nozzle corresponding to the at least one ejection event wherein the rate of change of temperature of the fluid ejection die corresponds to an ejected volume of fluid for the at least one ejection event, an expected rate of change of temperature corresponds to an expected volume of fluid for the at least one ejection event, the at least one nozzle characteristic comprises an operational status of the at least one nozzle, and the operational status of the at least one nozzle is determined to be non-operative based on the ejected volume of fluid for the at least one ejection event being less than the expected volume of fluid for the at least one ejection event.

* * * * *